US009969186B1

(12) United States Patent
Hasegawa

(10) Patent No.: US 9,969,186 B1
(45) Date of Patent: May 15, 2018

(54) INKJET PRINTER

(71) Applicant: Roland DG Corporation, Hamamatsu-shi, Shizuoka (JP)

(72) Inventor: Hideyuki Hasegawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days. days.

(21) Appl. No.: 15/841,362

(22) Filed: Dec. 14, 2017

(30) Foreign Application Priority Data

Dec. 20, 2016 (JP) ..... 2016-246785

(51) Int. Cl.
*B41J 2/01* (2006.01)
*B41J 11/00* (2006.01)
*B41J 2/21* (2006.01)

(52) U.S. Cl.
CPC ..... *B41J 11/002* (2013.01); *B41J 2/21* (2013.01)

(58) Field of Classification Search
CPC ..... B41J 11/002; B41J 29/38; B41J 2/21
USPC ..... 347/16, 102, 104
See application file for complete search history.

(56) References Cited

U.S. PATENT DOCUMENTS

| | | | | |
|---|---|---|---|---|
| 9,802,425 | B2 * | 10/2017 | Seki | B41J 11/002 |
| 2007/0188547 | A1 | 8/2007 | Kobayashi et al. | |
| 2011/0036255 | A1 * | 2/2011 | Monclus | B41J 11/002 101/424.1 |
| 2013/0108842 | A1 | 5/2013 | Shiono et al. | |
| 2016/0279972 | A1 | 9/2016 | Seki et al. | |

FOREIGN PATENT DOCUMENTS

| | | | |
|---|---|---|---|
| JP | 2007-050555 | A | 3/2007 |
| JP | 2010-030313 | A | 2/2010 |
| JP | 4889059 | B2 | 2/2012 |
| JP | 2013-095078 | A | 5/2013 |
| JP | 5425357 | B2 | 2/2014 |
| JP | 2014-111340 | A | 6/2014 |
| JP | 2015-096321 | A | 5/2015 |

* cited by examiner

*Primary Examiner* — Jannelle M Lebron
(74) *Attorney, Agent, or Firm* — Keating & Bennett, LLP

(57) ABSTRACT

A printer includes an ink head, a first heater, a second heater, and a controller. The ink head includes first and second ink heads arrayed along a main scanning direction. The first heater is upstream of the platen in a sub-scanning direction, and heats the recording medium. The second heater is below the platen, and heats the recording medium placed on the platen. The controller includes a heater controller that controls the first and second heaters so that the surface temperature of a first region in which a first ink ejected from a first upstream nozzle array lands becomes higher than the surface temperature of a second region in which a second ink ejected from the second downstream nozzle array lands.

12 Claims, 5 Drawing Sheets

INKJET PRINTER

CROSS REFERENCE TO RELATED APPLICATIONS

This application claims the benefit of priority to Japanese Patent Application No. 2016-246785 filed on Dec. 20, 2016. The entire contents of this application are hereby incorporated herein by reference.

BACKGROUND OF THE INVENTION

1. Field of the Invention

The present invention relates to inkjet printers.

2. Description of the Related Art

An inkjet printer that forms an image by laying different types of inks on a recording medium is well known. In other words, an inkjet printer capable of layered printing, in which two or more ink layers are formed, is well known.

For example, the inkjet printer disclosed in FIGS. 4 and 5 of Japanese Patent No. 5425357 B is equipped with an ejector head including a base-layer-forming sub-head and image-forming sub-heads. The base-layer-forming sub-head ejects white ink, and the image-forming sub-heads eject process color inks. This inkjet printer operates in the following manner. The white ink is ejected from half of the nozzles of the base-layer-forming subhead that are closer to the upstream end in the delivering direction of a recording medium to form a first ink layer on the recording medium. Thereafter, the process color inks are ejected from half of the nozzles of the image-forming sub-heads that are closer to the downstream end in the delivering direction of the recording medium to form a second ink layer over the earlier-formed first ink layer.

Japanese Patent No. 4889059 B discloses an inkjet printer equipped with a print heater and a preheater. The print heater heats a recording medium to facilitate drying of the ink ejected on the recording medium. The preheater is disposed upstream of a platen, to preliminarily heat the recording medium. In the inkjet printer disclosed in Japanese Patent No. 4889059 B, the temperature of the recording medium heated by the print heater and the temperature of the recording medium heated by the preheater are set to be equal so that the temperature of the recording medium surface will be 30° C. to 70° C. Consequently, the ink droplets that have landed on the recording medium are dried at the same temperature, and an image with a uniform visual impression is obtained.

SUMMARY OF THE INVENTION

In view of the foregoing and other problems, preferred embodiments of the present invention provide inkjet printers that make it possible to produce high-quality printed products by layered printing.

The present inventor has discovered that, in producing a printed product by forming a first ink layer on a recording medium and then forming a second ink layer over the first layer, it is possible to vary the ink dot size between the first ink layer and the second ink layer by varying the surface temperature of the recording medium when drying the ink that has landed on the recording medium, and as a result, even with inks ejected under the same condition, it is possible to print images having different visual effects.

Moreover, the present inventor has discovered that it is possible to produce high-quality printed products even without making the ink dot size uniform between the first ink layer and the second ink layer that are formed on the recording medium. Thus, it is possible to print images with different visual impressions by causing the surface temperature of the recording medium that is heated by a print heater and the surface temperature of the recording medium that is heated by a preheater to be different from each other.

An inkjet printer according to a preferred embodiment of the present invention includes a platen on which a recording medium is to be placed, an ink head that is movable along a main scanning direction and ejects ink onto the recording medium, a feeder that feeds the recording medium along a sub-scanning direction orthogonal to the main scanning direction, a first heater, disposed upstream of the ink head in the sub-scanning direction, that heats the recording medium, a second heater, disposed below the platen and at a position facing the ink head, that heats the recording medium placed on the platen, a controller electrically connected to the ink head, the feeder, the first heater, and the second heater to control the ink head, the feeder, the first heater, and the second heater, wherein the ink head includes a first ink head and a second ink head arrayed along the main scanning direction, the first ink head includes a first upstream nozzle array and a first downstream nozzle array, the first upstream nozzle array located upstream in the sub-scanning direction and including a plurality of nozzles arrayed along the sub-scanning direction, and the first downstream nozzle array located downstream in the sub-scanning direction and including a plurality of nozzles arrayed along the sub-scanning direction, the second ink head includes a second upstream nozzle array and a second downstream nozzle array, the second upstream nozzle array located upstream in the sub-scanning direction and including a plurality of nozzles arrayed along the sub-scanning direction, and the second downstream nozzle array located downstream in the sub-scanning direction and including a plurality of nozzles arrayed along the sub-scanning direction; the controller includes a first controller that causes the nozzles of the first upstream nozzle array to eject a first ink onto the recording medium, a second controller that causes the nozzles of the second downstream nozzle array to eject a second ink over the first ink, and a heater controller that controls the first heater and the second heater so that a surface temperature of a first region of the recording medium in which the first ink ejected from the nozzles of the first upstream nozzle array lands is higher than a surface temperature of a second region of the recording medium in which the second ink ejected from the nozzles of the second downstream nozzle array lands, and the first ink is a spot color ink, and the second ink is an image-producing ink.

The inkjet printer according to the just-described preferred embodiment of the present invention allows the first region of the recording medium, in which the first ink ejected from the nozzles of the first upstream nozzle array lands, to have a surface temperature higher than the surface temperature of the second region of the recording medium, in which the second ink ejected from the nozzles of the second downstream nozzle array lands. As a result, the surface temperature of the recording medium gradually increases from the upstream end toward the downstream end of the first region and the second region of the recording medium. This means that the first ink, which is ejected earlier, is dried in a relatively higher temperature range, while the second ink, which is ejected later, is dried in a relatively lower temperature range. As a result, the first ink is dried more quickly in the first ink layer, so the first ink is fixed on the recording medium in such a state that spreading of the first ink is significantly reduced or prevented. This produces a sharper image. On the other hand, in the second ink layer, the second ink is fixed on the first ink layer in such a state that the second ink spreads relatively widely over the first ink layer. This produces a smoother image. Thus, by varying the surface temperature of the recording medium when forming the first ink layer and the second ink layer, it is possible to print images with high quality and with different visual impressions.

An inkjet printer according to another preferred embodiment of the present invention includes a platen on which a recording medium is to be placed, an ink head that is movable along a main scanning direction and ejects ink onto the recording medium, a feeder that feeds the recording medium along a sub-scanning direction orthogonal to the main scanning direction, a first heater, disposed upstream of the ink head in the sub-scanning direction, that heats the recording medium, a second heater, disposed below the platen and at a position facing the ink head, that heats the recording medium placed on the platen, a controller electrically connected to the ink head, the feeder, the first heater, and the second heater to control the ink head, the feeder, the first heater, and the second heater, wherein the ink head includes a first ink head and a second ink head arrayed along the main scanning direction, the first ink head includes a first upstream nozzle array and a first downstream nozzle array, the first upstream nozzle array located upstream in the sub-scanning direction and including a plurality of nozzles arrayed along the sub-scanning direction, and the first downstream nozzle array located downstream in the sub-scanning direction and including a plurality of nozzles arrayed along the sub-scanning direction, the second ink head includes a second upstream nozzle array and a second downstream nozzle array, the second upstream nozzle array located upstream in the sub-scanning direction and including a plurality of nozzles arrayed along the sub-scanning direction, and the second downstream nozzle array located downstream in the sub-scanning direction and including a plurality of nozzles arrayed along the sub-scanning direction, the controller includes a first controller that causes the nozzles of the first upstream nozzle array to eject a first ink onto the recording medium, a second controller that causes the nozzles of the second downstream nozzle array to eject a second ink over the first ink, and a heater controller that controls the first heater and the second heater so that a surface temperature of a first region of the recording medium in which the first ink ejected from the nozzles of the first upstream nozzle array lands is lower than a surface temperature of a second region of the recording medium in which the second ink ejected from the nozzles of the second downstream nozzle array lands.

The inkjet printer according to the just-described preferred embodiment of the present invention allows the first region of the recording medium, in which the first ink ejected from the nozzles of the first upstream nozzle array lands, to have a surface temperature lower than the surface temperature of the second region of the recording medium, in which the second ink ejected from the nozzles of the second downstream nozzle array lands. As a result, the surface temperature of the recording medium gradually decreases from the upstream end toward the downstream end of the first region and the second region of the recording medium. This means that the first ink, which is ejected earlier, is dried in a relatively lower temperature range, while the second ink, which is ejected later, is dried in a relatively higher temperature range. As a result, in the first ink layer, the first ink is fixed on the recording medium in such a state that the first ink spreads relatively widely. This produces a smoother image. On the other hand, in the second ink layer, the second ink is dried more quickly, so the second ink is fixed over the first ink layer in such a state that spreading of the second ink is significantly reduced or prevented. This produces a sharper image. Thus, by varying the surface temperature of the recording medium when forming the first ink layer and the second ink layer, it is possible to print images of high quality and with different visual impressions.

Various preferred embodiments of the present invention provide inkjet printers that make it possible to produce high-quality printed products by layered printing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
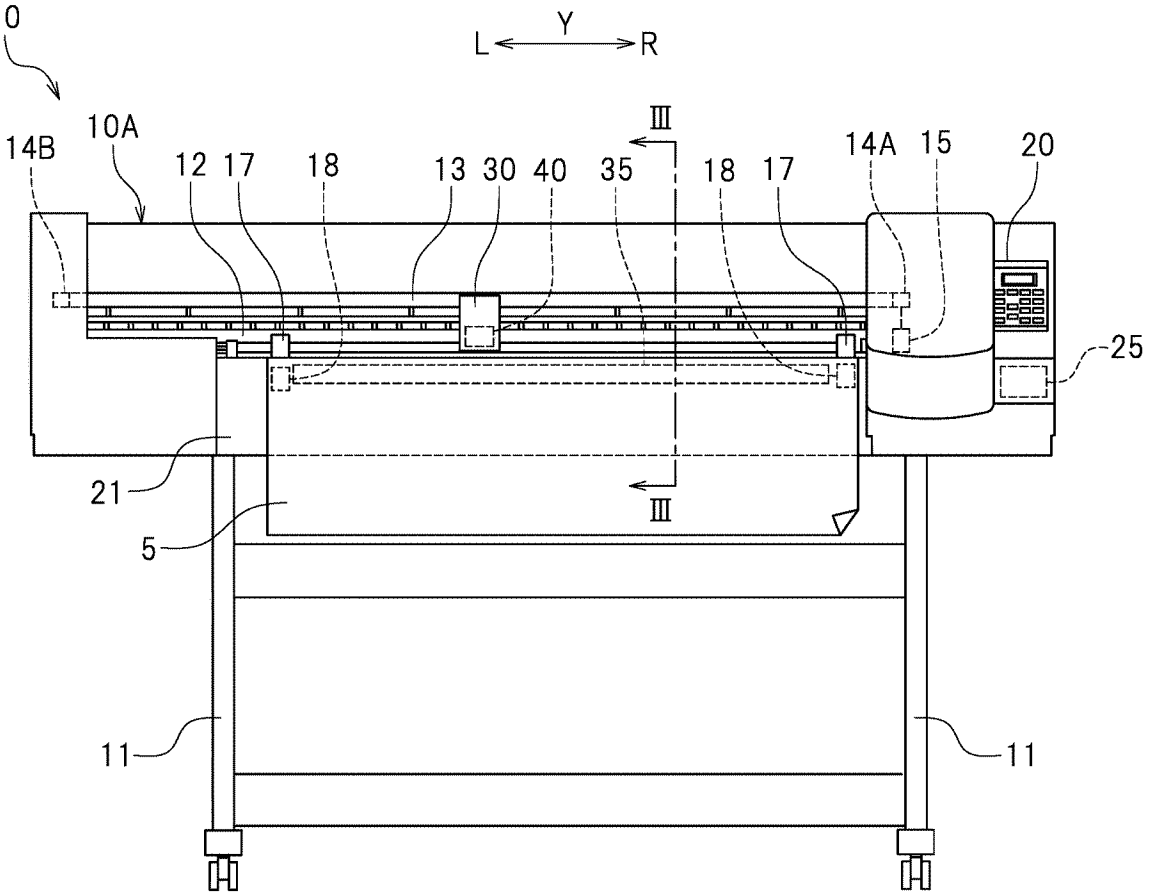
FIG. 1 is a front view illustrating an inkjet printer according to a preferred embodiment of the present invention.

Hereinbelow, inkjet printers according to preferred embodiments of the present invention will be described with reference to the drawings. It should be noted that preferred embodiments described herein are, of course, not intended to limit the present invention. The features and components that exhibit the same effects are denoted by the same reference symbols, and repetitive description thereof may be omitted as appropriate. In the following description, a direction toward the user relative to the inkjet printer is defined as "frontward", and a direction away from the user relative to the inkjet printer is defined as "rearward". In the drawings, reference character Y represents the main scanning direction, and reference character X represents the sub-scanning direction X that is orthogonal to the main scanning direction Y. In the drawings, reference characters F, Rr, L, and R represent front, rear, left, and right, respectively. These directional terms are, however, merely provided for convenience in description, and are not intended to limit in any way the manner in which the inkjet printer should be arranged.

First Preferred Embodiment

Figure 2:
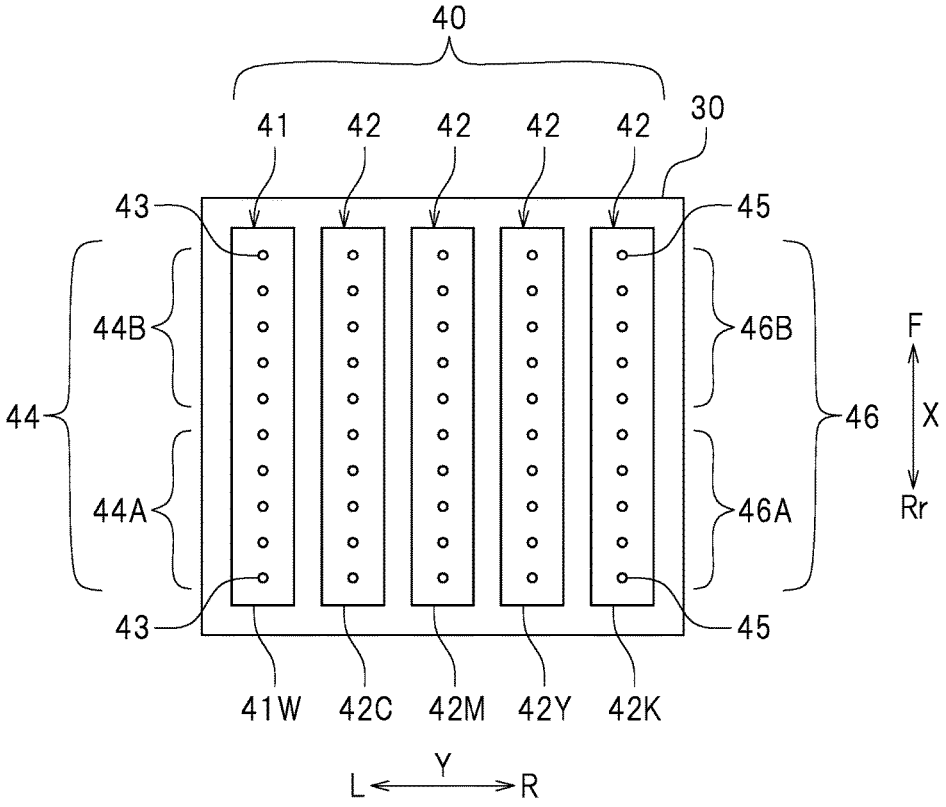
FIG. 2 is a schematic view illustrating the structure of a bottom surface of an ink head according to a preferred embodiment of the present invention.
Figure 3:
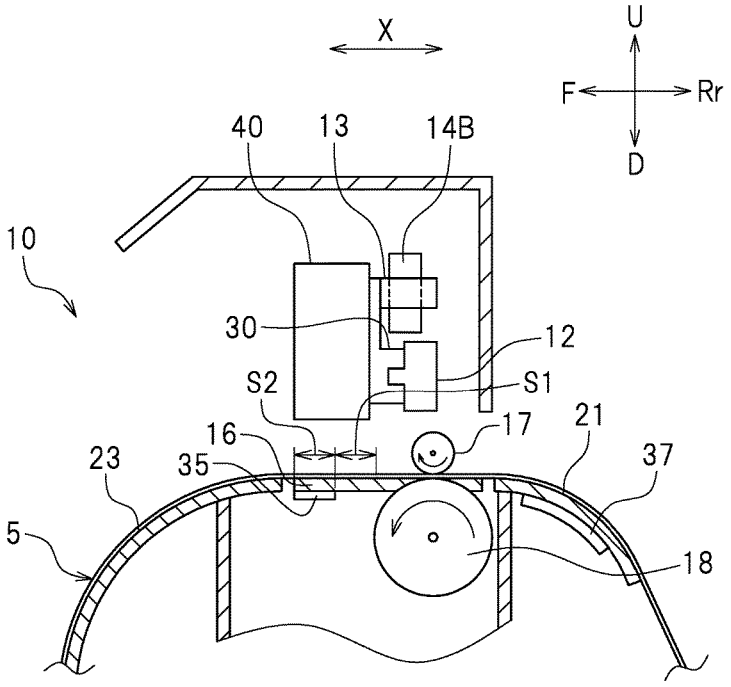
FIG. 3 is a cross-sectional view taken along line III-III in FIG. 1.
Figure 4:
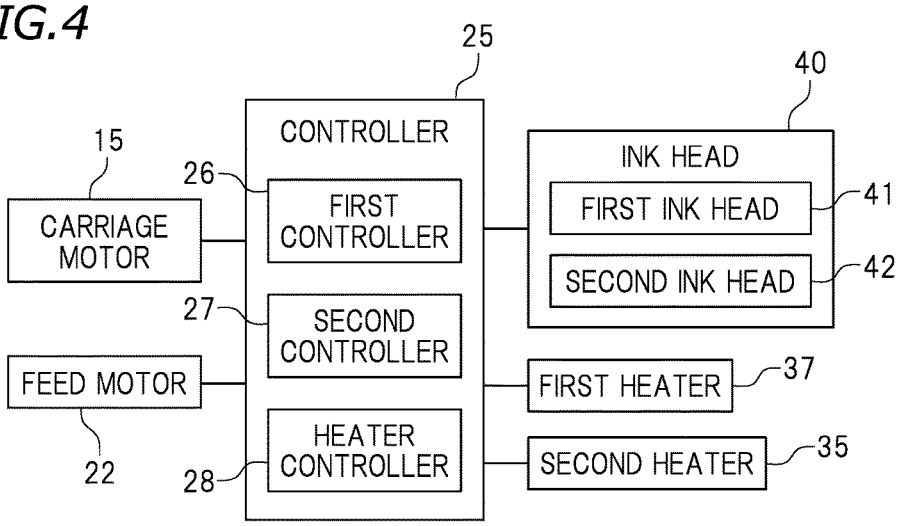
FIG. 4 is a block diagram illustrating a controller according to a preferred embodiment of the present invention.

FIG. 1 is a front view of a large-format inkjet printer (hereinafter simply "printer") 10 according to a preferred embodiment of the present invention. FIG. 2 is a schematic view illustrating the configuration of one surface of an ink head 40 (the bottom surface in the present preferred embodiment) that faces a recording medium 5. FIG. 3 is a cross-sectional view taken along line III-III in FIG. 1. FIG. 4 is a block diagram of a controller 25. The printer 10 prints images on the recording medium 5 by consecutively moving a recording medium 5 in a roll form frontward (i.e., toward the downstream end in the sub-scanning direction X) and ejecting ink from the ink head 40 (see also FIG. 2) that moves along the main scanning direction Y.

The recording medium 5 is an object on which images are to be printed. The recording medium 5 is not limited to a particular material. The recording medium 5 may be, for example, paper materials such as plain paper and printing paper for inkjet printers, transparent sheets made of glass or resin such as polyvinyl chloride (PVC) or polyester, and sheets made of metal or rubber. Note that when the recording medium 5 is coated with a coating agent, the ink that has landed on the surface of the recording medium 5 does not permeate into the areas around the locations on which the ink has landed, so the ink is fixed on the recording medium 5 in small-diameter dots.

As illustrated in FIG. 1, the printer 10 includes a printer main body 10A and legs 11 that support the printer main body 10A. The printer main body 10A extends along the main scanning direction Y. The printer main body 10A includes a guide rail 12 and a carriage 30 engaged with the guide rail 12. The guide rail 12 extends along the main scanning direction Y. The guide rail 12 guides movement of the carriage 30 along the main scanning direction Y. An endless belt 13 is secured to the carriage 30. The belt 13 is wrapped around a pulley 14A, which is disposed near the right end of the guide rail 12, and a pulley 14B, which is disposed near the left end of the guide rail 12. A carriage motor 15 is fitted to the right-side pulley 14A. The carriage motor 15 is electrically connected to a controller 25. The carriage motor 15 is controlled by the controller 25. Driven by the carriage motor 15, the pulley 14A rotates, and the belt 13 runs accordingly. Then, the carriage 30 moves in a main scanning direction Y along the guide rail 12. Thus, as the carriage 30 moves in a main scanning direction Y, the ink head 40 accordingly moves in the main scanning direction Y. In the present preferred embodiment, the belt 13, the pulley 14A, the pulley 14B, and the carriage motor 15 together provide a non-limiting example of the moving mechanism that moves the carriage 30 and the ink head 40 along the main scanning direction Y.

As illustrated in FIG. 1, a platen 16 is disposed below the carriage 30. The platen 16 extends along the main scanning direction Y. The recording medium 5 is to be placed on the platen 16. As illustrated in FIG. 3, pinch rollers 17 that press the recording medium 5 from above are provided above the platen 16. The pinch rollers 17 are disposed rearward relative to the carriage 30. The platen 16 is provided with grit rollers 18. The grit rollers 18 are disposed below the pinch rollers 17. The grit rollers 18 are provided at positions that face the pinch rollers 17. The grit rollers 18 are connected to a feed motor 22 (see FIG. 4). The grit rollers 18 are rotatable by receiving the driving force from the feed motor 22. The feed motor 22 is electrically connected to the controller 25. The feed motor 22 is controlled by the controller 25. As the grit rollers 18 rotate with the recording medium 5 being pinched between the pinch rollers 17 and the grit rollers 18, the recording medium 5 is delivered in a sub-scanning direction X. In the present preferred embodiment, the pinch rollers 17, the grit rollers 18, and the feed motor 22 are a non-limiting example of the feeder that moves the recording medium 5 along the sub-scanning direction X. During printing, the recording medium 5 is delivered toward the downstream end in the sub-scanning direction X (i.e., frontward) by a distance corresponding to a later-described first upstream nozzle array 44A (see FIG. 2) at a time.

The printer 10 includes the ink head 40. As illustrated in FIG. 2, the ink head 40 is mounted on the carriage 30. The ink head 40 includes a first ink head 41 and second ink heads 42. The first ink head 41 and the second ink heads 42 are arrayed along the main scanning direction Y.

As illustrated in FIG. 2, the first ink head 41 includes a head element 41W that ejects ink. The head element 41W ejects a so-called spot color ink to provide variety in hue and design in color images. The spot color ink is an example of the first ink. The head element 41W ejects white ink. In the present preferred embodiment, the first ink head 41 includes one head element, but the number of the head elements is not limited thereto. It is possible that the first ink head 41 may include, for example, two or more head elements. Moreover, the spot color ink used herein is not limited to any particular type of spot color ink. The first ink head 41 may include, for example, a head element that ejects a metallic ink such as silver ink or gold ink, a head element that ejects a gloss ink, or a head element that ejects a clear ink.

As illustrated in FIG. 2, the head element 41W includes a plurality of nozzles 43 arrayed along the sub-scanning direction X. In the present preferred embodiment, the plurality of nozzles 43 in the head element 41W are arrayed in one line to define a nozzle array 44. However, the arrangement of the nozzles 43 is not limited in any way. The nozzle array 44 includes a first upstream nozzle array 44A located upstream in the sub-scanning direction X, and a first downstream nozzle array 44B located downstream in the sub-scanning direction X. Although the number of nozzles 43 in the first upstream nozzle array 44A and the number of nozzles 43 in the first downstream nozzle array 44B are equal in the present preferred embodiment, they are not necessarily equal.

As illustrated in FIG. 2, the second ink heads 42 include a plurality of head elements 42C, 42M, 42Y, and 42K that eject ink. The plurality of head elements 42C, 42M, 42Y, and 42K are arrayed along the main scanning direction Y. Each of the plurality of head elements 42C, 42M, 42Y, and 42K ejects a process color ink (image-producing ink) for producing color images. The process color ink is an example of the second ink. The head element 42C ejects cyan ink. The head element 42M ejects magenta ink. The head element 42Y ejects yellow ink. The head element 42K ejects black ink. It should be noted that the number of the head elements of the second ink heads 42 is not limited to 4. It is possible that the number of the head elements of the second ink heads 42 may be, for example, five or more. It is also possible that the second ink head 42 may include only one head element (for example, the head element 42K only). Moreover, the process color inks that are used herein are not limited to any particularly type of process color ink.

As illustrated in FIG. 2, each of the plurality of head elements 42C, 42M, 42Y, and 42K includes a plurality of nozzles 45 arrayed along the sub-scanning direction X. In the present preferred embodiment, the plurality of nozzles 45 in each of the head elements 42C, 42M, 42Y, and 42K are preferably arrayed in one line to form a nozzle array 46. However, the arrangement of the nozzles 45 is not limited in any way. The nozzle array 46 includes a second upstream nozzle array 46A located upstream in the sub-scanning direction X, and a second downstream nozzle array 46B located downstream in the sub-scanning direction X. The nozzles 45 of the plurality of head elements 42C, 42M, 42Y, and 42K are disposed at positions aligned with respect to the sub-scanning direction X. The nozzles 45 of the plurality of head elements 42C, 42M, 42Y, and 42K and the nozzles 43 of the head element 41W are disposed at positions aligned with respect to the sub-scanning direction X. Although the number of the nozzles 45 in the second upstream nozzle array 46A and the number of the nozzles 45 in the second downstream nozzle array 46B are equal in the present preferred embodiment, they are not necessarily equal.

Although FIG. 2 shows that the head element 41W of the first ink head 41 and the head elements 42C, 42M, 42Y, and 42K of the second ink head 42 each include only 10 nozzles 43 or 45, it should be noted that each of the actual ink head elements includes an even larger number of nozzles 43 or 45 (for example, 300 nozzles). However, the number of the nozzles 43 and 45 is not limited to any number.

Actuators (not shown) each including a piezoelectric element, for example, are provided inside the head element 41W of the first ink head 41 and the head elements 42C, 42M, 42Y, and 42K of the second ink head 42. The actuators are electrically connected to the controller 25. The actuators are controlled by the controller 25. By actuating the actuators, ink is ejected from the nozzles 43 of the head element 41W and the nozzles 45 of the head elements 42C, 42M, 42Y, and 42K onto the recording medium 5.

The head elements 41W, 42C, 42M, 42Y, and 42K are allowed to communicate with ink cartridges (not shown) respectively by ink supply passages (not shown). The ink cartridges may be provided detachably, for example, in a right end portion of the printer main body 10A. The materials of the inks are not limited in any way, and various types of materials that have conventionally been used as the ink materials for inkjet printers may be used. The inks may be solvent-based pigment inks or aqueous pigment inks. The inks may also be aqueous inks, ultraviolet curing pigment inks that cure when irradiated with ultraviolet rays, or the like.

As illustrated in FIG. 3, the printer 10 includes an upstream guide 21. The upstream guide 21 is disposed upstream of the platen 16 in the sub-scanning direction X. In the present preferred embodiment, the upstream guide 21 is disposed rearward relative to the platen 16. The upstream guide 21 preferably has a circular arc-shaped transverse cross section. The upstream guide 21 may be provided with a portion that extends linearly. The upstream guide 21 is curved more downward as it is more distant from the platen 16. The upstream guide 21 guides the recording medium 5 to the platen 16. That is, the recording medium 5 is delivered along the upstream guide 21.

As illustrated in FIG. 3, the printer 10 includes a downstream guide 23. The downstream guide 23 is disposed downstream of the platen 16 in the sub-scanning direction X. In the present preferred embodiment, the downstream guide 23 is disposed frontward relative to the platen 16. The downstream guide 23 preferably has a circular arc-shaped transverse cross section. The downstream guide 23 may be provided with a portion that extends linearly. The downstream guide 23 is curved more downward as it is more distant from the platen 16. The downstream guide 23 guides the recording medium 5 on which the ink ejected from the ink head 40 has been adhered. The downstream guide 23 guides the recording medium 5, for example, to a take-up device (not shown).

As illustrated in FIG. 3, the printer 10 includes a first heater 37 and a second heater 35. The first heater 37 is disposed below the upstream guide 21. The first heater 37 is disposed upstream of the ink head 40 in the sub-scanning direction X. The first heater 37 is disposed rearward relative to the ink head 40. The first heater 37 is disposed upstream of the platen in the sub-scanning direction X. The first heater 37 is disposed rearward relative to the platen 16. The first heater 37 heats the upstream guide 21. By heating the upstream guide 21, a surface portion of the recording medium 5 that is placed on the upstream guide 21 is heated. The first heater 37 is able to heat the recording medium 5 to approximately 30° C. to approximately 70° C., for example. The first heater 37 is electrically connected to the controller 25. The temperature of the first heater 37 is controlled by the controller 25.

As illustrated in FIG. 3, the second heater 35 is disposed below the platen 16. The second heater 35 is disposed at a position facing the ink head 40. The second heater 35 is disposed downstream of the grit rollers 18 in the sub-scanning direction X. The second heater 35 is disposed frontward relative to the grit rollers 18. In the present preferred embodiment, the rear end of the second heater 35 is not located rearward relative to the ink head 40. However, it is possible that the rear end of the second heater 35 may be located rearward relative to the ink head 40. The second heater 35 heats the platen 16. By heating the platen 16, a surface portion of the recording medium 5 that is placed on the upstream guide 16 is heated. The second heater 35 is able to heat the recording medium 5 to approximately 30° C. to approximately 70° C., for example. The second heater 35 is electrically connected to the controller 25. The temperature of the second heater 35 is controlled by the controller 25.

As illustrated in FIG. 1, an operation panel 20 is provided on a right end portion of the printer main body 10A. The operation panel 20 is provided with a display that displays the operating status, input keys to be operated by the user, and the like. The controller 25 that controls various operations of the printer 10 is accommodated inside the operation panel 20. The controller 25 is communicatively connected to the feed motor 22, the carriage motor 15, the first heater 37, the second heater 35, and the ink head 40, and the controller 25 is able to control these components. As illustrated in FIG. 4, the controller 25 includes a first controller 26, a second controller 27, and a heater controller 28. The above-mentioned controllers may be implemented by either software or hardware. Each of the above-mentioned controllers may be implemented by a processor, or may be incorporated in a circuit.

The configuration of the controller 25 is not limited to a particular configuration. The controller 25 controls the ink head 40, the carriage motor 15, the feed motor 22, the first heater 37, and the second heater 35. The controller 25 may include a plurality of controllers each of which controls the foregoing components independently, or may be defined by a single controller that controls the foregoing components integrally. The controller 25 may be a microcomputer, for example. The hardware configuration of the microcomputer is not limited in any way. For example, the microcomputer may include an interface (I/F) that receives print data or the like from external apparatuses such as a host computer, a central processing unit (CPU) that executes control program instructions, a read only memory (ROM) that stores programs executed by the CPU, a random access memory (RAM) used as a working area for deploying the programs, and a storage device, such as a memory, that stores the foregoing programs and various data. The controller 25 need not be provided inside the printer main body 10A. For example, the controller 25 may be a computer that is provided external to the printer main body 10A and communicatively connected to the printer main body 10A via a wired or wireless communication.

The controller 25 receives data such as images to be printed. The controller 25 performs printing based on the input data. The controller 25 controls the feed motor 22 so that the recording medium 5 is delivered consecutively frontward (i.e., toward the downstream end in the sub-scanning direction X). The controller 25 drives the carriage motor 15 so as to cause the carriage 30 to move along the main scanning direction Y and also drives the actuators to eject inks from the first ink head 41 and the second ink heads 42, to cause the inks to land on the print surface of the recording medium 5. The controller 25 causes a spot color ink to be ejected onto the recording medium 5 while causing the carriage 30 to move along the main scanning direction Y one time or a plurality of times. Thereafter, the controller 25 causes the recording medium 5 to be delivered toward the downstream end (i.e., frontward) by a distance corresponding to the first upstream nozzle array 44A, and causes process color ink to be ejected over the ejected spot color ink. By repeating this process, an image is printed on the recording medium 5.

The printer 10 is able to perform layered printing, in which a layer of process color ink is stacked over a layer of spot color ink, in addition to normal printing, which uses only the second ink heads 42.

The first controller 26 causes the nozzles 43 of the first upstream nozzle array 44A to eject a spot color ink (such as white ink) onto the recording medium 5. The first controller 26 controls the head element 41W of the first ink head 41 so as to cause the nozzles 43 of the first upstream nozzle array 44A to eject the ink.

The second controller 27 causes the nozzles 45 of the second downstream nozzle array 46B to eject an image-producing ink (such as a process color ink) over the spot color ink that has been ejected onto the recording medium 5. The second controller 27 controls at least one of the head elements 42C, 42M, 42Y, and 42K of the second ink heads 42 so as to cause the nozzles 45 of the second downstream nozzle array 46B to eject the ink.

The heater controller 28 controls the first heater 37 and the second heater 35 so that a surface temperature T1 of a first region S1 of the recording medium 5, in which a first ink (for example, a spot color ink) ejected from the nozzles 43 of the first upstream nozzle array 44A lands, is higher than a surface temperature T2 of a second region S2 of the recording medium 5, in which a second ink (for example, an image-producing ink) ejected from the nozzles 45 of the second downstream nozzle array 46B lands. The heater controller 28 may detect, for example, the temperatures of the first heater 37 and the second heater 35 themselves to perform feedback control. Herein, the surface temperature T1 is a surface temperature of the recording medium 5 before the first ink (for example, a spot color ink) lands on the recording medium 5. For example, the surface temperature T1 and the surface temperature T2 preferably satisfies the relational expression 0.5° C.≤(T1−T2)≤30° C. The heater controller 28 controls the first heater 37 and the second heater 35 so that the surface temperature T1 of the first region S1 of the recording medium 5, which is heated by the first heater 37, is higher than the surface temperature T2 of the second region S2 of the recording medium 5, which is heated by the second heater 35. The heater controller 28 controls the first heater 37 and the second heater 35 so that the temperature of the first heater 37 is higher than the temperature of the second heater 35. It should be noted that the temperature of the first heater 37 and the temperature of the second heater 35 may be the same, as long as the surface temperature T1 of the first region S1 becomes higher than the surface temperature T2 of the second region S2. In the present preferred embodiment, the surface temperature T1 of the first region S1 is higher than the surface temperature T2 of the second region S2. This means that the surface temperature of the recording medium 5 gradually increases from the upstream end toward the downstream end of the first region S1 and the second region S2. Note that the first region S1 is a region that faces the first upstream nozzle array 44A when the ink head 40 moves along the main scanning direction Y. The second region S2 is a region that faces the second downstream nozzle array 46B when the ink head 40 moves along the main scanning direction Y.

Figure 5A:
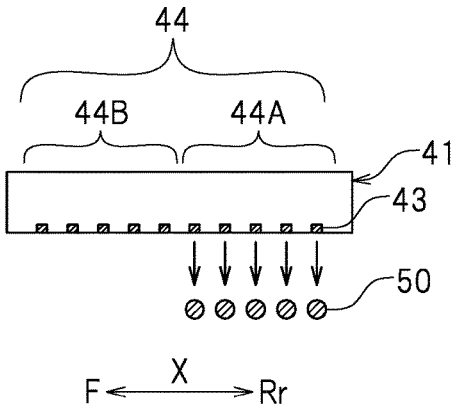
FIG. 5A is a schematic view illustrating how a spot color ink is ejected from a first ink head.
Figure 5B:
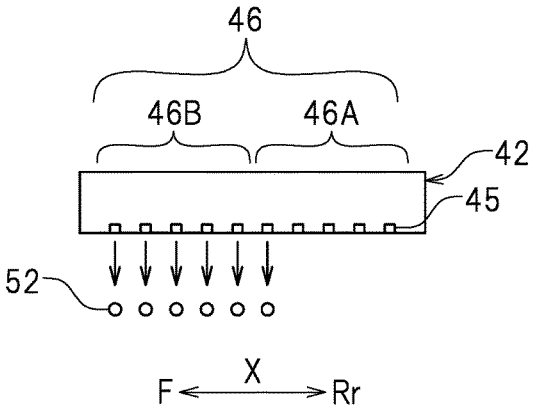
FIG. 5B is a schematic view illustrating how a process color ink is ejected from a second ink head.
Figure 5C:
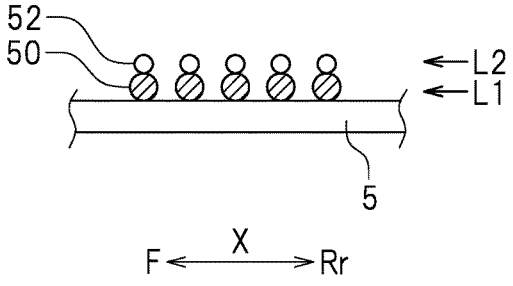
FIG. 5C is a schematic view illustrating how inks have been ejected on a recording medium.

FIG. 5A to FIG. 5C are schematic views for illustrating layered printing. During the time in which the carriage 30 and the ink head 40 mounted thereon move one time in one direction along the main scanning direction Y, or during the time they make one reciprocating movement in left and right directions along the main scanning direction Y, spot color ink 50 is ejected from the nozzles 43 of the first upstream nozzle array 44A of the first ink head 41 (see FIG. 5A). Then, the recording medium 5 on which the spot color ink 50 has been ejected is delivered toward the downstream end in the sub-scanning direction X by a distance corresponding to the first upstream nozzle array 44A. Thereafter, process color ink 52 is ejected from the nozzles 45 of the second downstream nozzle array 46B of the second ink heads 42 over the spot color ink 50 (see FIG. 5B). At this time, the heater controller 28 controls the surface temperature T1 of the first region S1 of the recording medium 5, which is heated by the first heater 37, to be 55° C., for example, and controls the surface temperature T2 of the second region S2 of the recording medium 5, which is heated by the second heater 35, to be 35° C., for example. In the present preferred embodiment, the spot color ink 50, which is ejected earlier, is heated and dried in a relatively higher temperature range (approximately 55° C. herein), so the spot color ink 50 is fixed on the recording medium 5 in a state in which spreading of the spot color ink 50 is significantly reduced or prevented. On the other hand, the process color ink 52 ejected over the spot color ink 50 is heated and dried in a relatively lower temperature range (approximately 35° C. herein), so the process color ink 52 is fixed in such a state that the process color ink 52 spreads widely over the spot color ink 50. As a result, as illustrated in FIG. 5C, a spot color ink layer L1 and a process color ink layer L2 are stacked on the recording medium 5. Such a preferred embodiment is suitable when, for example, printing a color image on a transparent medium as the recording medium 5 using white ink as the spot color ink.

As described above, the printer 10 according to the present preferred embodiment enables the surface temperature T1 of the first region S1, in which the spot color ink 50 ejected from the nozzles 43 of the first upstream nozzle array 44A lands, to be higher than the surface temperature T2 of the second region S2, in which the process color ink 52 ejected from the nozzles 45 of the second downstream nozzle array 46B lands. Accordingly, the surface temperature of the recording medium 5 gradually increases from the upstream end toward the downstream end of the first region S1 and the second region S2 of the recording medium 5. This means that the spot color ink 50, which is ejected earlier, is dried in a relatively higher temperature range, while the process color ink 52, which is ejected later, is dried in a relatively lower temperature range. As a result, in the spot color ink layer L1, the spot color ink 50 is dried more quickly, and the spot color ink 50 is fixed on the recording medium 5 in such a state that spreading of the spot color ink 50 is significantly reduced or prevented. This produces a sharper image. On the other hand, in the process color ink layer L2, the process color ink 52 is fixed on the spot color ink layer L1 in such a state that the process color ink 52 spreads relatively widely over the spot color ink 50. This produces a smoother image. Thus, by varying the surface temperature of the recording medium 5 when forming the spot color ink layer L1 and the process color ink layer L2, it is possible to print images of high quality and with different visual impressions.

In the printer 10 according to the present preferred embodiment, the heater controller 28 controls the first heater 37 and the second heater 35 so that the temperature of the first heater 37 is higher than the temperature of the second heater 35. This enables the surface temperature T1 of the first region S1 of the recording medium 5 to be higher than the surface temperature T2 of the second region S2 of the recording medium 5.

In the printer 10 according to the present preferred embodiment, the first heater 37 is disposed below the upstream guide 21. This makes it possible to heat the recording medium 5 in a region that is upstream of the platen 16.

In the printer 10 according to the present preferred embodiment, the ink that is ejected from the nozzles 43 of the first upstream nozzle array 44A is the spot color ink 50, such as white ink, and the ink that is ejected from the nozzles 45 of the second downstream nozzle array 46B is the process color ink 52. For example, when the recording medium 5 is made of a transparent material, it is possible to obtain a high-quality printed product because the process color ink layer L2 is formed after the spot color ink L1 is formed on the recording medium 5.

Second Preferred Embodiment

According to a second preferred embodiment of the present invention, the heater controller 28 controls the first heater 37 and the second heater 35 so that the surface temperature T1 of the first region S1 of the recording medium 5, in which the first ink (for example, a spot color ink) ejected from the nozzles 43 of the first upstream nozzle array 44A lands, is lower than the surface temperature T2 of the second region S2 of the recording medium 5, in which the second ink (for example, an image-producing ink) ejected from the nozzles 45 of the second downstream nozzle array 46B lands. For example, the relational expression $0.5° C. \leq (T2-T1) \leq 30° C.$ is satisfied. The heater controller 28 controls the first heater 37 and the second heater 35 so that the surface temperature T1 of the first region S1 of the recording medium 5, which is heated by the first heater 37, is lower than the surface temperature T2 of the second region S2 of the recording medium 5, which is heated by the second heater 35. The heater controller 28 controls the first heater 37 and the second heater 35 so that the temperature of the first heater 37 is lower than the temperature of the second heater 35. It should be noted that the temperature of the first heater 37 and the temperature of the second heater 35 may be the same, as long as the surface temperature T1 of the first region S1 becomes lower than the surface temperature T2 of the second region S2. In the present preferred embodiment, the surface temperature T1 of the first region S1 is lower than the surface temperature T2 of the second region S2. This means that the surface temperature of the recording medium 5 gradually decreases from the upstream end toward the downstream end of the first region S1 and the second region S2.

During the time in which the carriage 30 and the ink head 40 mounted thereon move one time in one direction along the main scanning direction Y, or during the time they make one reciprocating movement in left and right directions along the main scanning direction Y, spot color ink 50 is ejected from the nozzles 43 of the first upstream nozzle array 44A of the first ink head 41 (see FIG. 5A). In addition, the process color ink 52 is ejected from the nozzles 45 of the second downstream nozzle array 46B of the second ink heads 42 (see FIG. 5B). At this time, the heater controller 28 controls the surface temperature T1 of the first region S1 of the recording medium 5, which is heated by the first heater 37, to be about 35° C., for example, and controls the surface temperature T2 of the second region S2 of the recording medium 5, which is heated by the second heater 35, to be about 55° C., for example. In the present preferred embodiment, the spot color ink 50, which is ejected earlier, is heated and dried in a relatively lower temperature range (approximately 35° C. herein), so the spot color ink 50 is fixed on the recording medium 5 in a state in which the spot color ink 50 spreads relatively widely. On the other hand, the process color ink 52 ejected over the spot color ink 50 is heated and dried quickly in a relatively higher temperature range (approximately 55° C. herein), so the process color ink 52 is fixed over the spot color ink 50 in such a state that spreading of the process color ink 52 is significantly reduced or prevented. As a result, as illustrated in FIG. 5C, a spot color ink layer L1 and a process color ink layer L2 are stacked in that order from the bottom, on the recording medium 5.

The printer 10 according to the present preferred embodiment enables the surface temperature T1 of the first region S1, in which the spot color ink 50 ejected from the nozzles 43 of the first upstream nozzle array 44A lands, to be lower than the surface temperature T2 of the second region S2, in which the process color ink 52 ejected from the nozzles 45 of the second downstream nozzle array 46B lands. Accordingly, the surface temperature of the recording medium 5 gradually decreases from the upstream end toward the downstream end of the first region S1 and the second region S2 of the recording medium 5. This means that the spot color ink 50, which is ejected earlier, is dried in a relatively lower temperature range, while the process color ink 52, which is ejected later, is dried in a relatively higher temperature range. As a result, in the spot color ink layer L1, the spot color ink 50 is fixed on the recording medium in such a state that the spot color ink 50 spreads relatively widely. This produces a smoother image. On the other hand, in the process color ink layer L2, the process color ink 52 is dried more quickly, so the process color ink 52 is fixed on the spot color ink layer L1 in such a state that spreading of the process color ink 52 is significantly reduced or prevented. This produces a sharper image. Thus, by varying the surface temperature of the recording medium 5 when forming the spot color ink layer L1 and the process color ink layer L2, it is possible to print images of high quality and with different visual impressions.

In the printer 10 according to the present preferred embodiment, the heater controller 28 controls the first heater 37 and the second heater 35 so that the temperature of the first heater 37 is lower than the temperature of the second heater 35. This enables the surface temperature T1 of the first region S1 of the recording medium 5 to be lower than the surface temperature T2 of the second region S2 of the recording medium 5.

Hereinabove, preferred embodiments of the present invention have been described. It should be noted, however, that the foregoing preferred embodiments are merely exemplary and the present invention may be embodied in various other forms.

In the foregoing preferred embodiments, the first controller 26 causes the nozzles 43 of the first upstream nozzle array 44A to eject white ink (a spot color ink), and the second controller 27 causes the nozzles 45 of the second downstream nozzle array 46B to eject a process color ink (an image-producing ink), for example. However, this is not necessarily required to practice the present invention. It is also possible that the first controller 26 may cause the nozzles 43 of the first upstream nozzle array 44A to eject a process color ink, and the second controller 27 may cause the nozzles 45 of the second downstream nozzle array 46B to eject white ink.

Figure 6A:
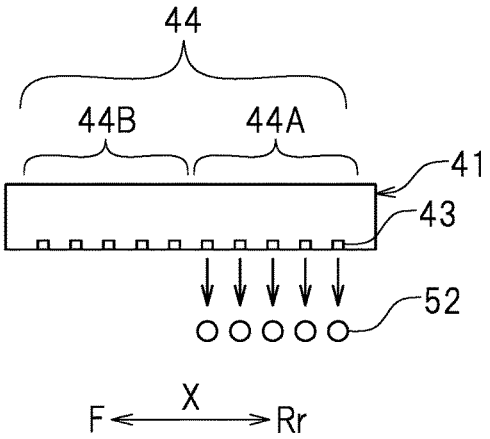
FIG. 6A is a schematic view illustrating how a process color ink is ejected from the first ink head.
Figure 6B:
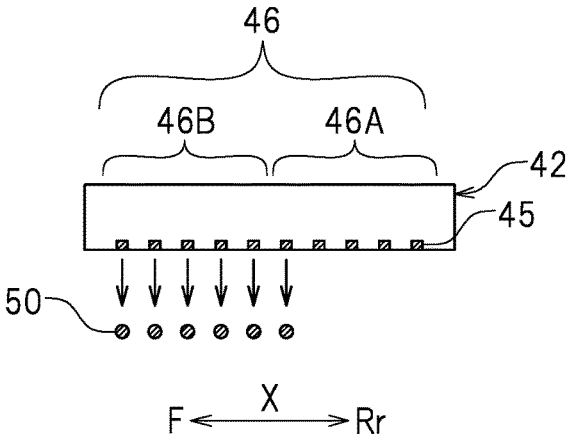
FIG. 6B is a schematic view illustrating how a spot color ink is ejected from the second ink head.
Figure 6C:
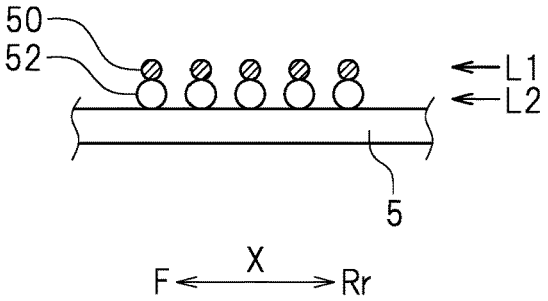
FIG. 6C is a schematic view illustrating how inks have been ejected on a recording medium, according to another preferred embodiment of the present invention.

In this case, during the time in which the carriage 30 and the ink head 40 mounted thereon move one time in one direction along the main scanning direction Y, or during the time they make one reciprocating movement in left and right directions along the main scanning direction Y, a process color ink 52 is ejected from the nozzles 43 of the first upstream nozzle array 44A of the first ink head 41 (see FIG. 6A). Then, the recording medium 5 on which the process color ink 52 has been ejected is delivered toward the downstream end in the sub-scanning direction X by a distance corresponding to the first upstream nozzle array 44A. Thereafter, a spot color ink 50 is ejected from the nozzles 45 of the second downstream nozzle array 46B of the second ink heads 42 over the process color ink 52 (see FIG. 6B). For example, in cases where the spot color ink 50, which is ejected earlier, is heated and dried in a relatively lower temperature range (approximately 35° C. herein), the process color ink 52 is fixed in such a state that the process color ink 52 spreads widely. On the other hand, in cases where the spot color ink 50 ejected over the process color ink 52 is heated and dried in a relatively higher temperature range (approximately 55° C. herein), the spot color ink 50 is fixed on the process color ink 52 in such a state that spreading of the spot color ink 50 is significantly reduced or prevented. As a result, as illustrated in FIG. 6C, a process color ink layer L2 and a spot color ink layer L1 are stacked in that order from the bottom, on the recording medium 5.

In the foregoing preferred embodiments, the first ink head 41 and the second ink heads 42 are mounted on the same carriage 30, for example, but this is not necessarily required to practice the present invention. The first ink head 41 and the second ink heads 42 may be mounted on separate carriages 30 and may be moved by separate carriage motors.

In the foregoing preferred embodiments, the carriage 30 moves along the main scanning direction Y and the recording medium 5 moves along the sub-scanning direction X, for example, but this is not necessarily required to practice the present invention. The movements of the carriage 30 and the recording medium 5 are relative, so either one of them may move along the main scanning direction Y or along the sub-scanning direction X. For example, it is possible that the recording medium 5 may be placed immovably and the carriage 30 may be allowed to move both along the main scanning direction Y and the sub-scanning direction X. Alternatively, it is possible that both the carriage 30 and the recording medium 5 may be allowed to move both along the main scanning direction Y and the sub-scanning direction X.

In the foregoing preferred embodiments, the second heater 35 may heat only the second region S2, or it may heat the first region S1 in addition to the second region S2. In this case, it is possible that the second heater 35 may heat both the first region S1 and the second region S2 to substantially the same temperature, or that the second heater 35 may heat the second region S2 to a temperature higher than that of the first region S1, or that the second heater 35 may heat the second region S2 to a temperature lower than that of the first region S1.

Furthermore, the technology disclosed herein may be applied to various types of inkjet printers. In addition to the so-called roll-to-roll inkjet printers as shown in the foregoing preferred embodiments, in which a rolled recording medium 5 is delivered, the technology may also be applied to flat-bed inkjet printers, for example, in a similar manner. Moreover, the printer 10 is not limited to a printer that is to be used alone as an independent printer, but may be a printer that is combined with another apparatus. For example, the printer 10 may be incorporated in another apparatus.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a platen on which a recording medium is to be placed;

an ink head that is movable along a main scanning direction and ejects ink onto the recording medium;

a feeder that feeds the recording medium along a sub-scanning direction perpendicular or substantially perpendicular to the main scanning direction;

a first heater, disposed upstream of the ink head in the sub-scanning direction, that heats the recording medium;

a second heater, disposed below the platen and at a position facing the ink head, that heats the recording medium placed on the platen; and a controller electrically connected to the ink head, the feeder, the first heater, and the second heater to control the ink head, the feeder, the first heater, and the second heater; wherein the ink head includes a first ink head and a second ink head arrayed along the main scanning direction;

the first ink head includes a first upstream nozzle array and a first downstream nozzle array, the first upstream nozzle array located upstream in the sub-scanning direction and including a plurality of nozzles arrayed along the sub-scanning direction, and the first downstream nozzle array located downstream in the sub-scanning direction including a plurality of nozzles arrayed along the sub-scanning direction;

the second ink head includes a second upstream nozzle array and a second downstream nozzle array, the second upstream nozzle array located upstream in the sub-scanning direction and including a plurality of nozzles arrayed along the sub-scanning direction, and the second downstream nozzle array located downstream in the sub-scanning direction and including a plurality of nozzles arrayed along the sub-scanning direction;

the controller includes:

a first controller that causes the nozzles of the first upstream nozzle array to eject a first ink;

a second controller that causes the nozzles of the second downstream nozzle array to eject a second ink over the first ink; and a heater controller that controls the first heater and the second heater so that a surface temperature of a first region of the recording medium in which the first ink ejected from the nozzles of the first upstream nozzle array lands is higher than a surface temperature of a second region of the recording medium in which the second ink ejected from the nozzles of the second downstream nozzle array lands; and the first ink is a spot color ink, and the second ink is an image-producing ink.

2. The inkjet printer according to claim 1, wherein the heater controller controls the first heater and the second heater so that the surface temperature of the first region of the recording medium that is heated by the first heater is higher than the surface temperature of the second region of the recording medium that is heated by the second heater.

3. The inkjet printer according to claim 1, wherein the second heater heats the second region to a temperature higher than that of the first region.

4. The inkjet printer according to claim 2, wherein the heater controller controls the first heater and the second heater so that the temperature of the first heater is higher than the temperature of the second heater.

5. The inkjet printer according to claim 1, further comprising:

an upstream guide, disposed upstream of the platen in the sub-scanning direction, that guides the recording medium; wherein the first heater is disposed below the upstream guide.

6. An inkjet printer comprising:

a platen on which a recording medium is to be placed;

an ink head being that is movable along a main scanning direction and ejects ink onto the recording medium;

a feeder that feeds the recording medium along a sub-scanning direction perpendicular or substantially perpendicular to the main scanning direction;

a first heater, disposed upstream of the ink head in the sub-scanning direction, that heats the recording medium;

a second heater, disposed below the platen and at a position facing the ink head, that heats the recording medium placed on the platen; and a controller electrically connected to the ink head, the feeder, the first heater, and the second heater to control the ink head, the feeder, the first heater, and the second heater; wherein the ink head includes a first ink head and a second ink head arrayed along the main scanning direction;

the first ink head includes a first upstream nozzle array and a first downstream nozzle array, the first upstream nozzle array located upstream in the sub-scanning direction and including a plurality of nozzles arrayed along the sub-scanning direction, and the first downstream nozzle array located downstream in the sub-scanning direction including a plurality of nozzles arrayed along the sub-scanning direction;

the second ink head includes a second upstream nozzle array and a second downstream nozzle array, the second upstream nozzle array located upstream in the sub-scanning direction and including a plurality of nozzles arrayed along the sub-scanning direction, and the second downstream nozzle array located downstream in the sub-scanning direction and including a plurality of nozzles arrayed along the sub-scanning direction;

the controller includes:

a first controller that causes the nozzles of the first upstream nozzle array to eject a first ink;

a second controller that causes the nozzles of the second downstream nozzle array to eject a second ink over the first ink; and a heater controller that controls the first heater and the second heater so that a surface temperature of a first region of the recording medium in which the first ink ejected from the nozzles of the first upstream nozzle array lands is lower than a surface temperature of a second region of the recording medium in which the second ink ejected from the nozzles of the second downstream nozzle array lands.

7. The inkjet printer according to claim 6, wherein the heater controller controls the first heater and the second heater so that the surface temperature of the first region of the recording medium that is heated by the first heater is lower than the surface temperature of the second region of the recording medium that is heated by the second heater.

8. The inkjet printer according to claim 6, wherein the second heater heats the second region to a temperature lower than that of the first region.

9. The inkjet printer according to claim 7, wherein the heater controller controls the first heater and the second heater so that the temperature of the first heater is lower than the temperature of the second heater.

10. The inkjet printer according to claim 6, further comprising:

an upstream guide, disposed upstream of the platen in the sub-scanning direction, that guides the recording medium; wherein the first heater is disposed below the upstream guide.

11. The inkjet printer according to claim 6, wherein the first ink is a spot color ink, and the second ink is an image-producing ink.

12. The inkjet printer according to claim 6, wherein the first ink is an image-producing ink, and the second ink is a spot color ink.

* * * * *